US006262527B1

(12) United States Patent
Van Zutphen et al.

(10) Patent No.: US 6,262,527 B1
(45) Date of Patent: Jul. 17, 2001

(54) CATHODE RAY TUBE WITH A GETTER COATING IN THE VICINITY OF A SEMICONDUCTOR CATHODE

(75) Inventors: Tom Van Zutphen; Frederik C. Gehring, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/153,776

(22) Filed: Sep. 15, 1998

(30) Foreign Application Priority Data

Sep. 29, 1997 (EP) ..... 97202978

(51) Int. Cl.[7] ..... H01J 31/00
(52) U.S. Cl. ..... 313/481; 313/547
(58) Field of Search ..... 313/414, 481, 313/545, 546, 547, 548, 553, 558, 559, 560, 310, 326

(56) References Cited

U.S. PATENT DOCUMENTS

| | | | | |
|---|---|---|---|---|
| 3,564,327 | * | 2/1971 | Johnson | 313/181 |
| 4,231,627 | * | 11/1980 | Schaffernicht et al. | 316/25 |
| 4,609,847 | * | 9/1986 | Ashizaki et al. | 313/413 |
| 4,721,882 | * | 1/1988 | Van Daelen | 313/481 |
| 4,736,135 | * | 4/1988 | Zwier et al. | 313/546 |
| 4,771,214 | * | 9/1988 | Takenaka et al. | 313/479 |
| 4,940,300 | * | 7/1990 | Giorgi | 313/559 |
| 5,243,197 | | 9/1993 | Van Gorkom et al. | 257/10 |
| 5,712,529 | * | 1/1998 | Ricaud et al. | 313/558 |

* cited by examiner

*Primary Examiner*—Ashok Patel
*Assistant Examiner*—Matthew J. Gerike

(57) ABSTRACT

Cathode ray tube comprising an electron gun which is constructed in such a way that the gas pressure near the electron-emissive layer (30) of the cathode is lower than in the other parts of the tube. This can be achieved by reducing the aperture between the G1 (33) and G2 (36), by providing the G2 (36) with a skirt (43). The wall of the skirt, the G1 and the G2 may also be at least partly coated with a getter (41).

12 Claims, 2 Drawing Sheets

CATHODE RAY TUBE WITH A GETTER COATING IN THE VICINITY OF A SEMICONDUCTOR CATHODE

The invention relates to a cathode ray tube provided with an electron gun which comprises at least a first and a second grid, and at least one cathode which, during operation, emits electrons by way of semiconductor action.

A cathode ray tube is suitable as a pick-up or display tube, but may be alternatively used in apparatus for Auger spectroscopy, electron microscopy and electron lithography.

A cathode ray tube for a monochrome display device, for example a television or monitor, has a glass envelope which is composed of a screen and a cone. The widest end of the cone is secured to the screen. Its narrowest end terminates in a tubular end having a substantially circular cross-section, which end is referred to as the neck. A phosphor screen consisting of a phosphor layer is present on the screen. The tubular end accommodates an electron gun which emits an electron beam during operation. This beam can be sent to a given spot on the display screen by means of deflection coils which generate a given magnetic field.

The display screen is activated by scanning the electron beam along the screen, which beam is modulated by a video signal. This video signal ensures that the phosphors are excited in accordance with such a pattern that their luminescence produces an image. When many electrons land on the pixel during its excitation time, this pixel luminesces more brightly. The video signal is applied to the cathode via electric current conductors.

There are many pixels per unit of surface area. Moreover, the pixels are excited one after the other within a very short time. The viewer thus experiences a moving image from a normal viewing distance.

In a color display device, for example a color television or a color monitor, each pixel has three phosphor elements each luminescing in a different primary color. As it were, there are three uniform regular patterns on the display screen, each pattern having a different luminescence color. Instead of one electron beam, three electron beams emitted by three different cathodes in the color electron gun are scanned along the screen during operation. Each of these three beams excites the pixels with a given luminescence color. Since the phosphor elements of a pixel are located close together, the viewer experiences them as a single element, not as separate elements. The color which is experienced is a mixed color of the three elements. By exciting each element with a given intensity, the viewer experiences a given color. For example, if the red element and the blue element are excited to a large extent and the green element is excited to a small extent, the viewer will experience the mixed color purple. Furthermore, similarly as for a monochrome cathode ray tube, it holds that the pixels are situated so close together that the viewer does not see them as separate pixels from a normal viewing distance. This produces a color image.

During production, the envelope of the cathode ray tube must be vacuum-exhausted before it is sealed. This is essential for its operation because an electron beam can only propagate substantially undisturbed through vacuum.

The electron beams are generated in, and emitted by an electron gun. This electron gun comprises a plurality of electrostatic grids which, in their sequence of increasing distance to the neck, are referred to as G1, G2, G3 and so forth. The different electrostatic grids have different electric potentials during operation and must therefore not be in contact with each other. To achieve this, they are fixed relative to each other by means of glass rods in which they are secured by means of brackets. The first grid G1 (grid 1) has a skirt accommodating one or more cathodes. These cathodes have a surface which emits electrons during operation. An electron emitted by such a cathode passes through an aperture in the G1 and subsequently through apertures in the G2, G3, and so forth. Finally, the electron leaves the electron gun so as to move towards the display screen.

Hitherto, thermionic cathodes emitting electrons by thermal radiation have mainly been used in electron guns for cathode ray tubes. Such a cathode has an envelope accommodating a filament and a cap from which the electrons are emitted. The cap is made of a sintered material. The surface of this cap is provided with barium which has the effect of decreasing the work function for the thermal emission. However, this barium is oxidized on the surface by residual gases, particularly oxygen, which are still in the tube after it has been vacuum-exhausted and sealed or which are released from the wall of the envelope or the materials from which the other parts of the cathode ray tube are made. Due to diffusion, barium is supplemented from the sintered material. When the concentration of oxidizing gases in the vicinity of the cathode exceeds a given value, the dispense is too slow to maintain the barium layer. It has been found that the gas may have a maximal pressure of $10^{-10}$ to $10^{-9}$ Pa to ensure a satisfactory electron emission. This pressure range is maintained as a standard in the production of cathode ray tubes.

There is a problem when, instead of thermionic cathodes, cathodes are used which operate by way of semiconductor action (referred to as "semiconductor cathodes"). These may be, for example field emitters that particularly reverse-biased junction cathodes (such as the avalanche cold cathode). A cathode of this type is described in U.S. Pat. No. 5,243,197. The surface of a semiconductor cathode also bears a material decreasing the work function. This is preferably cesium. Here, too, the material decreasing the work function is attacked by residual gases. Particularly the oxidation by oxygen-containing gases is harmful. Dispensing cesium from within a semiconductor cathode is, however, impossible because this cathode does not have a thick cap of sintered material, which is porous, but has a smooth surface instead. Cesium can neither be dispensed from the bulk of the cathode because the cathode has such a low temperature that the cesium has a negligible diffusion rate. The standard gas pressure in a cathode ray tube which is allowed for a thermionic cathode will rapidly render a semiconductor cathode inactive. In a standard CRT, semiconductor cathodes will thus rapidly get out of order.

It is an object of the invention to provide a cathode ray tube comprising an electron gun in which a semiconductor cathode can function at a standard pressure.

To this end, the cathode ray tube according to the invention is characterized in that the electron gun comprises means for making the partial gas pressure of oxidizing residual gases near the cathode lower than in other parts of the tube.

This means may be a getter, positioned near the cathode, in the electron gun, which getter removes oxidizing gas molecules. The relevant space near the cathode is very small with respect to the other parts of the tube. When the tube is put into operation, gases can be removed from the cathode space with a small amount of getter. Subsequently, gas still enters the cathode space from the other parts of the tube, but this can be limited by means of a getter provided on the walls of the electron gun. This may be done in a very efficient way if the apertures in the cathode space comply with at least one of the following conditions:

The aperture is "out of sight" of the cathode. This means that no straight line can be drawn between the aperture and the cathode. A gas molecule thus has to collide first with a wall if it is to reach the cathode. If this wall is provided with a getter, the molecule will certainly be captured.

The means comprise means for reducing the distance between the first and the second grid, forming an aperture (40) between the first and the second grid having a length (1) which is at least more than twice its distance (d). There is a small risk that a gas molecule passes through such aperture without colliding with a wall. As a result, only a small quantity of gas diffuses through it per unit of time. When the walls are coated with a getter, practically all of these few gas molecules which come through are captured by the getter.

These and other aspects of the invention are apparent from and will be elucidated with reference to the embodiments described hereinafter.

Figure 1:
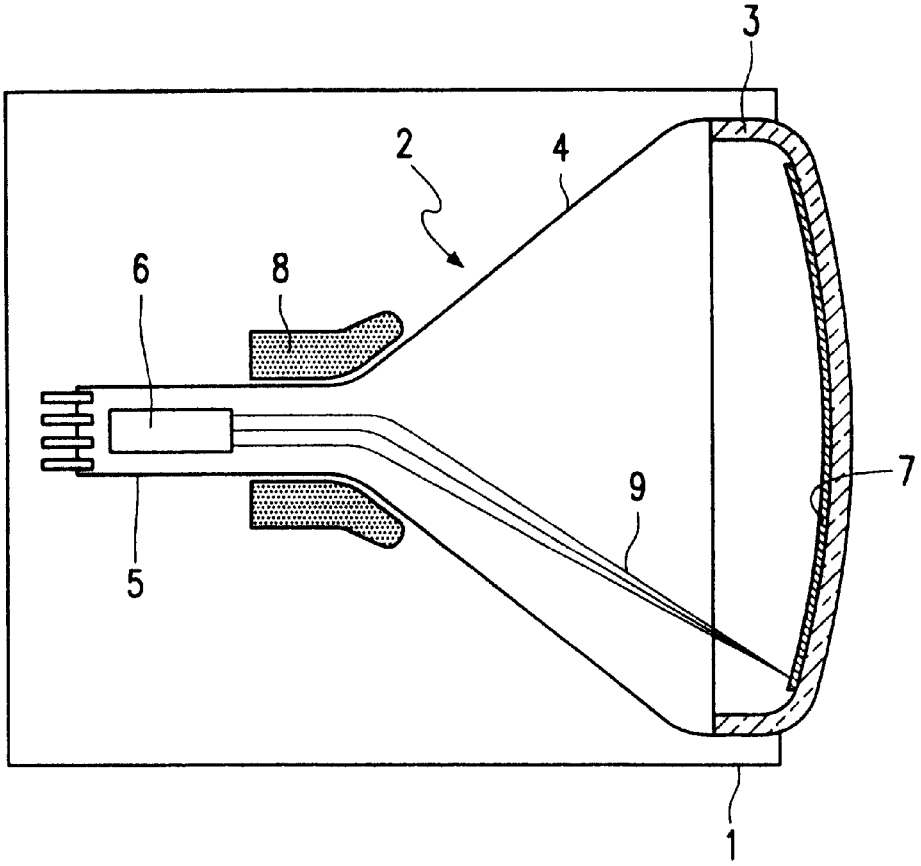
FIG. 1 PRIOR ART
FIG. 1 is a diagrammatic cross-section of a display device.

FIG. 1 is a diagrammatic cross-section of a display device. A cabinet 1 accommodates a cathode ray tube 2. The cathode ray tube 2 has a glass envelope which is composed of a screen 3 and a cone 4. The reference numeral 5 denotes the neck. The glass envelope accommodates an electron gun 6 and a phosphor screen 7. Deflection coils 8 are arranged around the cathode ray tube. When the device is operative, the electron gun 6 emits electrons which, if desired, are deflected by the deflection coils 8, whereafter they land on the desired spot on the phosphor screen 7. The electron gun accommodates one or more cathodes (not shown). When operating a color display device, three electron beams are generated by means of an electron gun comprising three separate cathodes. The reference numeral 9 denotes these three electron beams.

Figure 2:
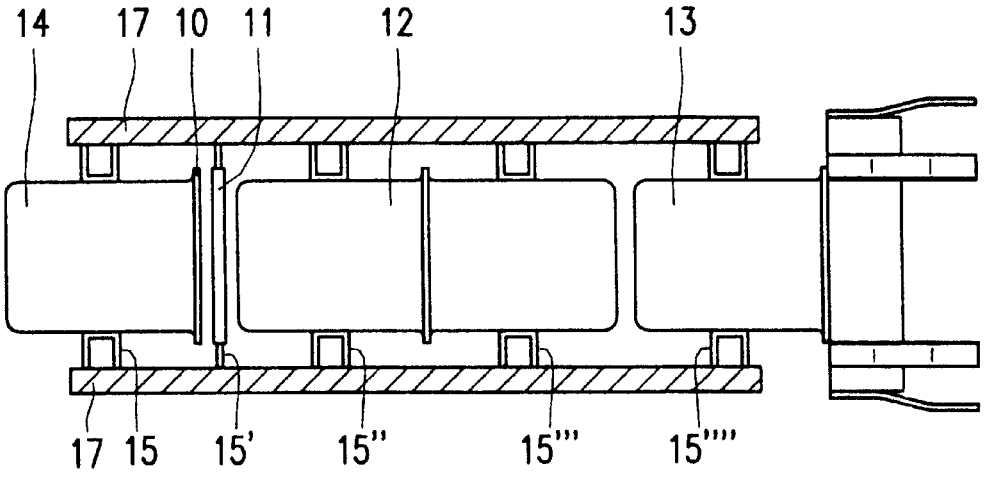
FIG. 2 PRIOR ART
FIG. 2 is a diagrammatic cross-section of an electron gun.

FIG. 2 is a diagrammatic cross-section of an electron gun. An electron gun emits electron beams towards the screen of the display device. Such a gun comprises a plurality of consecutively arranged electrostatic grids 10, 11, 12, 13. The first grid, the G1, 10 has a skirt 14 accommodating one or more cathodes (not shown). The grids are provided with brackets 15, 15', 15", 15''', 15''''. The brackets of the electrostatic grids are pressed into glass rods 17 during the production process while these rods are still soft. After cooling of the rods 17, the grids 10, 11, 12, 13 are positioned and fixed with respect to each other.

Figure 3:
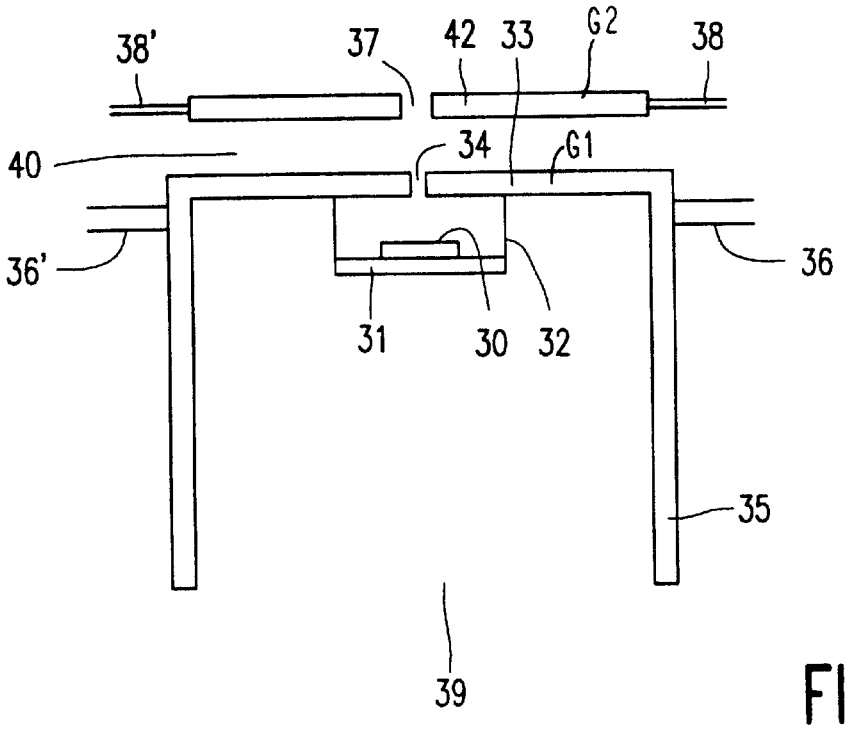
FIG. 3 PRIOR ART
FIG. 3 is a diagrammatic cross-section of a part of a conventional electron gun of a display device, provided with semiconductor cathodes.

FIG. 3 is a diagrammatic cross-section of a part of an electron gun in a display device, provided with semiconductor cathodes. A support 31 is provided with a layer of electron-emissive material 30. The support 31 is secured by means of straps 32 to the first grid (G1) 33. The first grid (G1) 33 has an aperture 34 through which electrons emitted by the cathode during operation find their way to the further grid system of the electron gun. The first grid 33 has a skirt 35 and brackets 36, 36'. The second grid (G2) 42 is present close to the first grid 33. The second grid has also an aperture 37 and brackets 38, 38'. The electron emission from layer 30 is made possible by a material decreasing the work function and provided on the layer 30. This material is often cesium. A frequent problem is not to lose the cesium. An important cause of cesium loss is oxidation. The oxidation is caused by gas particles, particularly oxygen-containing molecules which reach the electron-emissive layer 30 through the aperture 39 of the skirt and the aperture 40 between the first grid 33 and the second grid 42.

The oxidation can be limited to a considerable extent by capturing oxidizing gas particles with the aid of a getter. This can be done efficiently by giving the electron gun a special geometry. Both measures form part of the invention.

Figure 4:
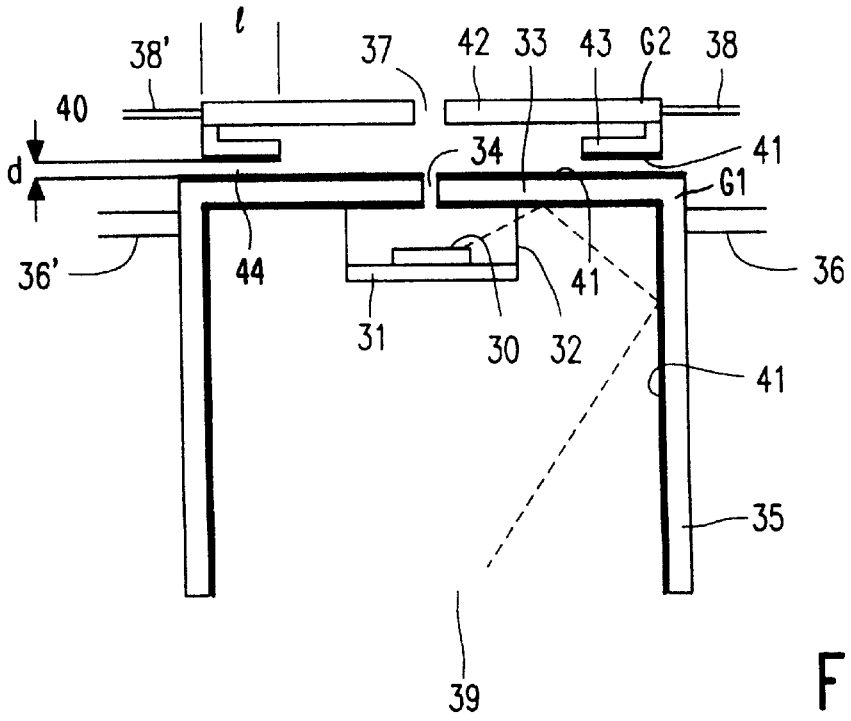
FIG. 4 is a diagrammatic cross-section of a part of an electron gun of a display device according to the invention, provided with semiconductor cathodes.

FIG. 4 is a diagrammatic cross-section of a part of an electron gun of a display device according to the invention, provided with semiconductor cathodes.

During production, a cathode ray tube is vacuum exhausted and sealed. Yet, gas molecules are left behind. A total vacuum cannot be realized. In addition to these residual molecules, gas is also released from the walls of the glass envelope and components which are present within the glass envelope. These residual gases attack the surface of the cathode(s). Correction means have been developed for this. In thermionic cathodes, the upper layer of the material decreasing the work function is supplemented from within throughout the lifetime of the cathode ray tube. In the production of cathode ray tubes, a maximum final pressure is maintained at which the thermionic cathodes used can still maintain their effect with this correction means.

Also in a semiconductor cathode, the material decreasing the work function is attacked by oxidizing residual gases. Dispensing from within a semiconductor cathode is, however, impossible. Consequently, if an electron gun with semiconductor cathodes is built into standard cathode ray tubes, these cathode ray tubes do not have the desired lifetime.

This problem can be solved by using a special electron gun in which, after its incorporation in a cathode ray tube, the partial gas pressure of the oxidizing residual gases in the vicinity of the semiconductor cathodes can be maintained lower than in the other parts of the tube. This is possible because the cathode space is small in comparison with the other parts of the tube. When oxidizing residual gases have been removed from the cathode space with a getter after the tube has been put into operation, the lower partial gas pressure then obtained for these gases can be maintained. This is effected by capturing incoming oxidizing gas molecules with the aid of the getter. This may be, for example barium, a getter for oxygen-containing gases. When a getter particle captures a gas particle, it binds itself to this particle and cannot capture another particle. It is thus important to limit the rate of incoming gas so that the getter then has a longer lifetime. It is also important that gas particles cannot easily reach the cathode directly but should preferably first collide with a wall. They can then be removed by providing a getter on this wall.

Particularly, the following two steps are taken to keep gas particles away from the cathodes:

During production, a getter (preferably barium) is sputtered in the electron gun, which getter is provided on the wall of the skirt 35 and the G1 33 and on the lower edge of the G2 42. The getter deposition is denoted by reference numeral 41. Gas molecules which come in through the aperture 39 of the skirt 35 from the direction of the base of the tube will collide at least once with a wall before they can reach a cathode surface. An example of such a path is denoted by means of the broken line. On this collision, they are captured by the getter. The G2 42 is provided with an inward-folded skirt 43. Gas molecules which come in through the aperture 40 between the G1 and G2 should then first pass through a long narrow constriction 44. Only molecules which are substantially parallel to the axis of the constriction can pass without colliding with the wall of the constriction. Most gas molecules will, however, collide with the wall of the constriction and be captured by the getter present on this constriction.

The invention thus relates to a cathode ray tube comprising an electron gun which is constructed in such a way that the gas pressure near the electron-emissive layer 30 of the cathode is lower than in the rest of the tube. This can be achieved by reducing the distance d between the G1 33 and G2 42 by providing the G2 42 with, for instance a skirt 43. The wall of the skirt, the G1 and the G2 may also be partly covered with a getter 41.

The distance d of aperture 40 is preferably less than half the length 1 of the aperture 40 ($1 \geqq 2d$).

What is claimed is:

1. A cathode ray tube provided with an electron gun which comprises;

at least a first and a second grid, and at least one cathode which, during operation, emits electrons by way of semiconductor action through the first grid and the second grid, in that order, toward a screen surface of the cathode ray tube, characterized in that the electron gun comprises means for making a partial gas pressure of oxidizing gases near the cathode lower than in regions of the tube beyond the second grid toward the screen.

2. A cathode ray tube as claimed in claim 1, characterized in that the cathode is arranged in the cathode ray tube so that molecules of oxidizing gases exterior to the electron gun are substantially prevented from reaching the cathode in a straight line.

3. A cathode ray tube as claimed in claim 1, characterized in that the means includes forming an aperture between the first and the second grid having a length that is at least more than twice a distance between the first and second grid defined by the aperture, so as to prevent molecules of oxidizing gases from travelling in a straight line through the aperture and to the cathode.

4. A cathode ray tube as claimed in claim 1, characterized in that the means comprises a skirt which is connected to the second grid, said skirt having an inwardly folded part which has a width which is at least twice as large as a mutual distance between the second electrostatic grid and the skirt.

5. A cathode ray tube as claimed in claim 1, characterized in that the means comprises a getter on at least a part of an interior wall of the electron gun.

6. A cathode ray tube as claimed in claim 5, characterized in that the getter mainly consists of barium.

7. A cathode ray tube provided with an electron gun comprising:

at least a first and a second grid, and at least one cathode which, during operation, emits electrons by way of semiconductor action through the first grid and the second grid, in that order, toward a screen, characterized in that the electron gun comprises a getter that is deposited on a surface in the vicinity of the at least one cathode, for making a partial gas pressure of oxidizing gases near the cathode lower than in regions of the cathode ray tube beyond the second grid toward the screen.

8. A cathode ray tube as claimed in claim 7, characterized in that the at least one cathode is arranged in the electron gun so that molecules of oxidizing gases exterior to the electron gun are substantially prevented from reaching the cathode in a straight line.

9. A cathode ray tube as claimed in claim 7, characterized in that the first and second grids are arranged with an aperture that maintains a distance between the first and second grids, and the aperture between the first grid and the second grid has a length which is at least twice the distance between the first and second grids, so as to prevent molecules of oxidizing gases from travelling in a straight line through the aperture and to the cathode.

10. A cathode ray tube as claimed in claim 9, further including a skirt that is connected to the second grid, the skirt having an inwardly folded part that forms the aperture between the first and second grids.

11. A cathode ray tube as claimed in claim 7, characterized in that the getter mainly consists of barium.

12. A cathode ray tube as claimed in claim 7, characterized in that the at least one cathode is arranged in the electron gun so that molecules of oxidizing gases exterior to the electron gun are more likely to hit a wall of the electron gun than to hit the cathode.

* * * * *